United States Patent [19]

Gonzalez y. Rojas

[11] Patent Number: 4,932,719

[45] Date of Patent: Jun. 12, 1990

[54] INCLINABLE STOOL

[76] Inventor: Enrique M. Gonzalez y. Rojas, Mar Egeo No. 1544 Lomas de Country, Guadalajara, Jalisco, Mexico

[21] Appl. No.: 406,668

[22] Filed: Sep. 13, 1989

[30] Foreign Application Priority Data

Aug. 4, 1988 [MX] Mexico ..... 12556

[51] Int. Cl.[5] ..... B62J 1/00

[52] U.S. Cl. ..... 297/338; 297/195; 297/310; 248/171

[58] Field of Search ..... 297/345, 338, 195, 293; 248/167, 170, 171, 131, 158, 160, 161, 415, 188.9

[56] References Cited

U.S. PATENT DOCUMENTS

| | | | |
|---|---|---|---|
| 3,181,828 | 5/1965 | Caamer | 297/338 X |
| 4,183,579 | 1/1980 | Gonzalez y Rojas | 297/195 |
| 4,366,981 | 1/1983 | Ziegler et al. | 297/195 X |
| 4,381,690 | 5/1983 | Kimble | 248/171 X |
| 4,607,882 | 8/1986 | Opsuik | 257/195 |
| 4,691,892 | 9/1987 | Grewe et al. | 248/170 X |
| 4,865,382 | 9/1989 | Marshall | 297/195 |

*Primary Examiner*—Peter A. Aschenbrenner
*Attorney, Agent, or Firm*—Pennie & Edmonds

[57] ABSTRACT

An inclinable stool for supporting the weight of the body and permitting a variety of inclined positions comprises a tripod base, supporting a vertically extending spring hinge assembly, a support column mounted on the spring hinge assembly and inclinable relative thereto, and a seat assembly disposed on the support column. A pair of spaced stabilizing members slidably and pivotally mounted to the support column rotate with the seat assembly and support column, thereby supporting the seated user against backwardly directed inclinations while allowing forward and lateral inclinations, regardless of the rotated position of the seat.

14 Claims, 3 Drawing Sheets

FIG. 3
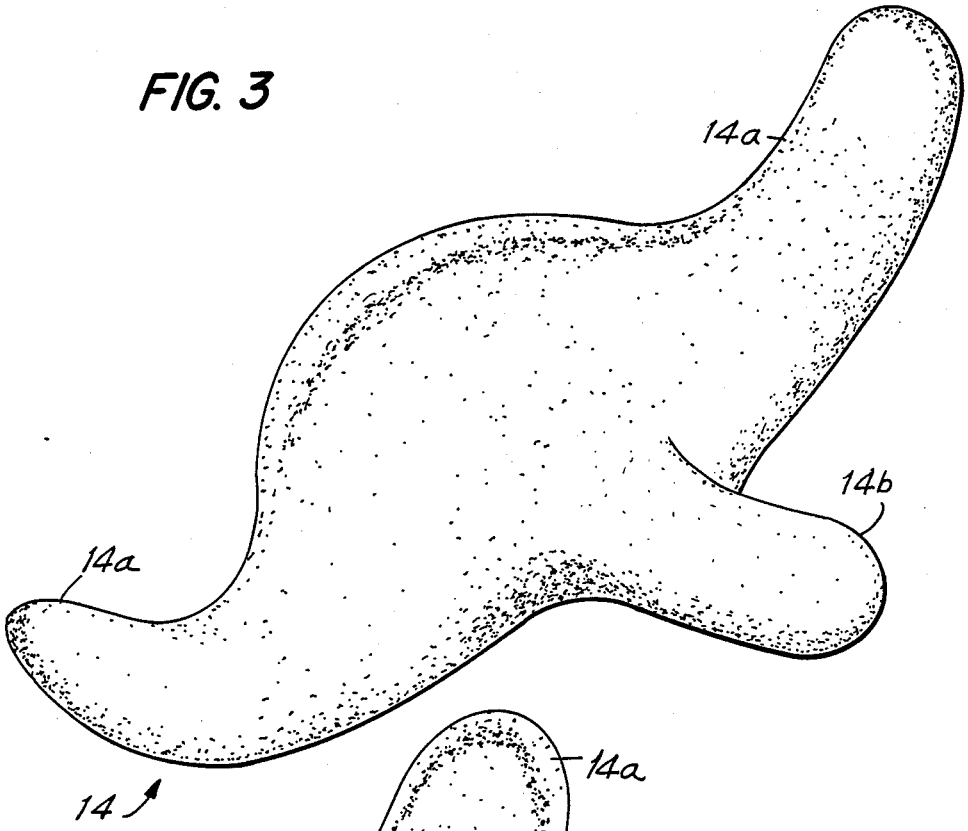
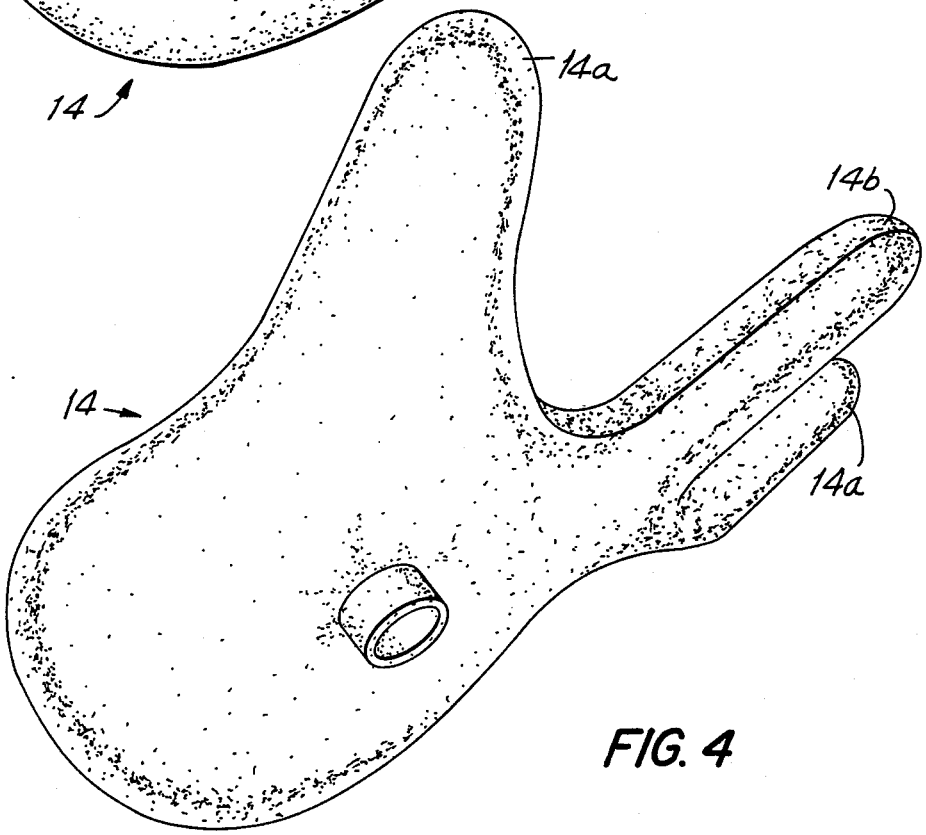
FIG. 4

INCLINABLE STOOL

FIELD OF THE INVENTION

The present invention relates generally to stools and high chairs capable of inclining and swiveling and relates more particularly to stools and high chairs capable of inclining and swiveling but supported against rearward inclination that cause the user to lose balance.

BACKGROUND AND OBJECTS OF THE INVENTION

U.S. Pat. No. 4,183,579 to Enrique M. Gonzalez y Rojas, the applicant herein, ("the '579 patent"hereafter) discloses a stool designed to support a user in near-standing position for extended periods of time while allowing the user to maneuver on the stool without slipping out of place or becoming unstable at any time. For example, during surgical procedures, doctors must often stand for lengthy periods. The stool of the '579 patent is designed to take part of the standing load off the doctor's legs while allowing him to stably lean in his seated position in various directions.

The stool of the '579 patent comprises a seat disposed on an elongated support column which is mounted to a tripod base. The support column provides a spring hinge assembly for allowing inclination of the seat and the support column relative to the tripod base. The spring hinge assembly biases the support column in an upright position.

Using leg movements, the user can incline the stool of the '579 patent and thereby extend his range of motion while maintaining a seated position on the stool. To prevent the stool from tipping during these inclination maneuvers, the outer ends of the tripod base legs provide suction cups to attach securely to the floor.

In addition, a pair of elongated stabilizing members extend from the central portion of the support column of the stool of the '579 patent to the floor outwardly beyond the base legs. The stabilizing members are spaced apart and attached to the support column above the spring hinge assembly by a pivoting and sliding linkage. As such, when the seat and support column are inclined forward or laterally, the lower ends of the stabilizing members slide toward the stool while the upper ends slide up the support column. By following the motion of the support column, the stabilizing members do not interfere with the smooth motion of the stool. During these manuevers, the user's legs provide the stabilizing support otherwise provided by the stabilizing members.

When the stool is returned to a vertical position, the stabilizing members slide down and out to support any load directed to the rear. Hence, the user may apply backward leaning forces without fear of tipping over.

Although the stool of the '579 patent generally provides stability for a range of inclined positions, it has a significant limitation in its support capabilities. Because of the angled positions of the stabilizing members, any lateral inclination of the seat and support member lifts one of the stabilizing members from the floor, thereby reducing stability for the maneuver. Moreover, when the seat is rotated relative to the support column so that the stabilizing members are no longer positioned behind the user, e.g. a 90 degree left or right turn, the stabilizing members no longer prevent the seat from being inclined rearwardly, so that the user can lose his balance.

Accordingly, it is an object of the invention to provide an inclinable stool with a swivel mechanism in which the stabilizing members rotate with the seat to provide maximum stability regardless of the direction of inclination.

The stabilizing members of the stool of the '579 patent are attached to the support column in such a manner that, upon sufficient forward inclination, the lower ends of the stabilizing members strike the legs of the tripod base, causing abrupt jolts which could disturb a doctor's critical hand positioning during surgery.

It is, therefore, another object of the invention to provide a clamp stop on the support column for restricting the motion of the stabilizing members so that they do not strike the base legs and interrupt the rotary motion of the stool.

The seat employed in the stool of the '579 patent has a tapering, generally rectangular form similar to the shape commonly used for bicycle and motorcycle seats. Because this seat design provides no lateral hip and buttocks support, standing loads are concentrated at the center of the user's thighs and buttocks, causing cramping in these muscle groups.

Hence, it is a further object of the present invention to provide an anatomically designed seat for fully supporting the user's upper thighs and buttocks while providing a pair of concavities on the front surface for positioning of the user's legs. As will be shown below, the seat design also provides easier rotation with increased control.

Still another object of this invention is to facilitate manufacture of the stool by providing parts designed for quicker assembly than the '589 stool.

SUMMARY OF THE INVENTION

The present invention overcomes the drawbacks of the prior art stool of the '579 patent by providing an inclinable stool with an anatomically designed seat for greater comfort and control, a swivel mechanism that ensures the stabilizing members are continuously positioned for maximum stability, a stop means for preventing collision between the base legs and the stabilizing members, and parts redesigned for quicker assembly.

The general design of the stool of the present invention is similar to that of the stool of the '579 patent, having been modified as set forth below. The swivel mechanism of the present invention is positioned in the support column so that rotation of the upper portion of the support column relative to the tripod base occurs below the pivoting and sliding linkage for the stabilizing members. As a result, the seat, the support column, and the stabilizing members rotate together, maintaining their relative alignment. Because they rotate with the seat, the stabilizing members constantly provide support against backward inclination from any rotated seat position.

A stop clamp is located on the upper portion of the support column above the slide collar for the stabilizing members. When the stool is inclined forward, the slide is urged upward by the pivoting stabilizing members. Simultaneously, the lower ends of the stabilizing members approach the base legs. By placing a clamp on the support column to limit the travel of the slide, the travel of the lower ends is correspondingly restrained, thus avoiding contact between the stabilizing members and the base legs. This clamp can also be adjusted to control the range of motion of the stabilizing members by raising or lowering its position on the support column.

As mentioned above, the anatomically designed seat of the present invention provides greater standing load support to the user. In addition, the front surface of the seat provides two cutaways for placement of the user's legs. With the prior seat design, the user uses his inner thighs to rotate the seat. The present seat design forms extensions that flank the user's outer thighs as well as a central extension positioned between the user's legs. With these extensions, the user can more easily rotate the stool using both thighs rather than one. Additionally, one thigh can be used to drive the rotation of the seat while the other thigh functions as a brake, thereby better controlling the rotation of the stool.

Other improvements and benefits of the present invention will become apparent from the detailed description set forth below.

DESCRIPTION OF THE DRAWINGS

The invention will be better understood by reference to the accompanying drawings, illustrating an embodiment thereof in which:

FIG. 3 a right elevation of the seat of the inclinable stool from above; and

FIG. 4 is a right elevation of the seat from below.

DESCRIPTION OF THE PREFERRED EMBODIMENT

Figure 1:
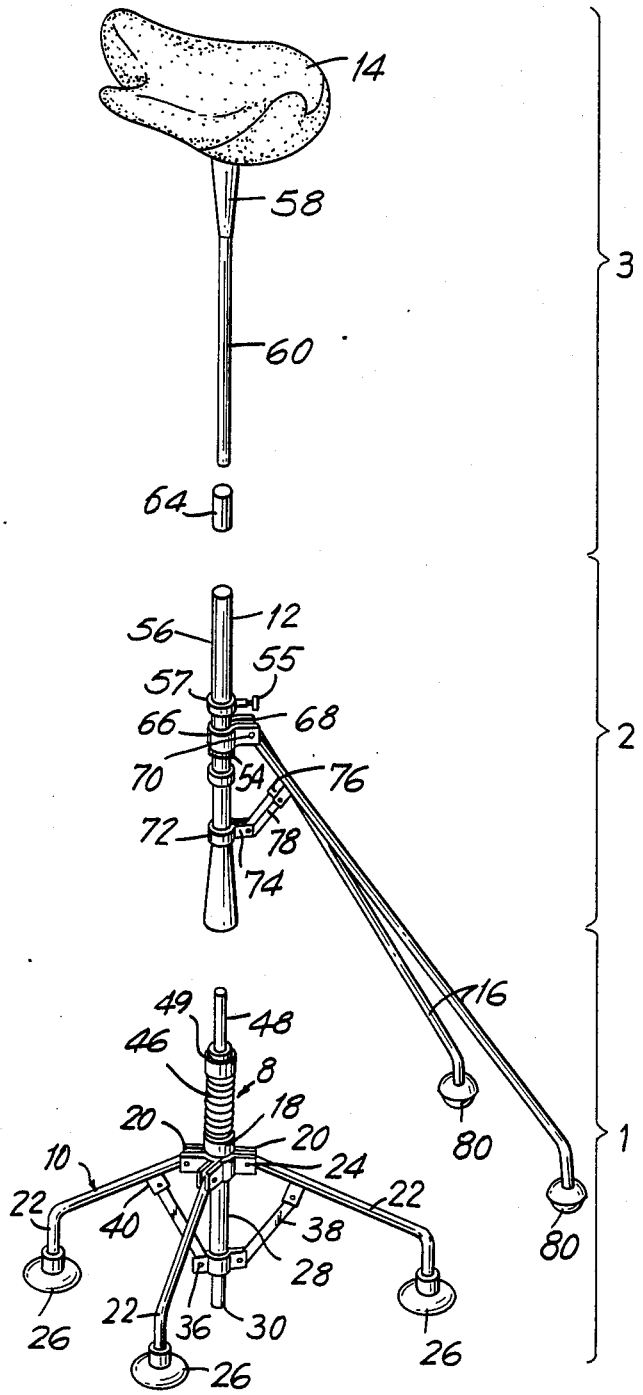
FIG. 1 is an exploded side elevation of the inclinable stool.

The inclinable stool of the present invention consists of three separable sections, facilitating its storage and transport. Referring to FIG. 1, a bottom section 1 consists of a tripod base, generally designated 10, and a spring hinge assembly, generally designated 8; a middle section 2 comprises a support column 12 connected to a pair of stabilizing members 16; and a top section 3 comprises a seat support rod 60 and a seat 14.

Figure 2:
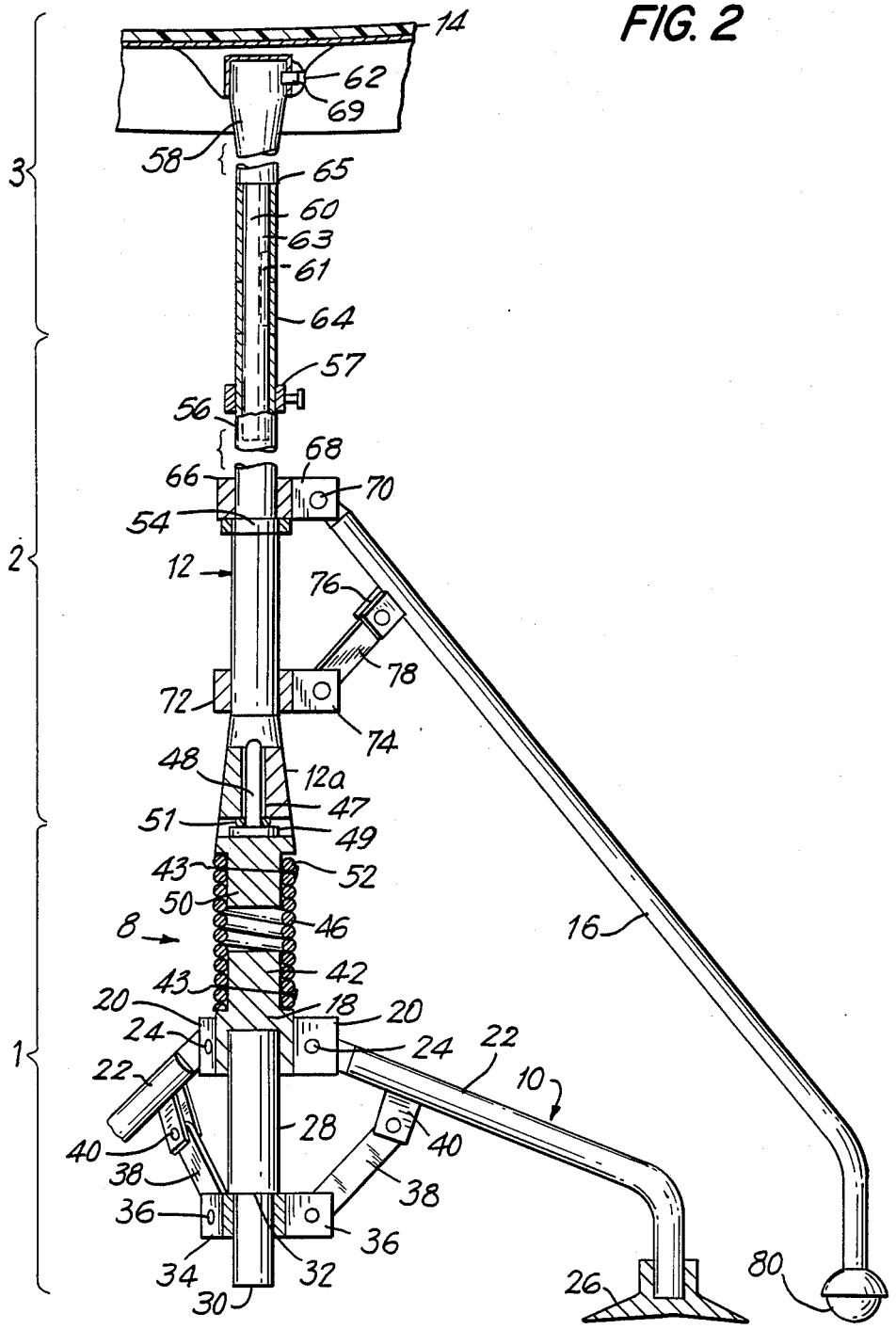
FIG. 2 is cross-sectional view thereof.

Referring to FIG. 2, the tripod base 10 has a cylindrical hub 18 providing three radially separated hub forks 20, each pivotally connected to a base leg 22. A guide post 28 is mounted integrally to the hub 18, having a lower portion 30 of smaller diameter than a top portion 32. On the lower portion 30, a base sleeve 34 is slidably mounted, having three radially separated sleeve forks 36, each sleeve fork 36 rotatably holding a link 38 whose other end is rotatably coupled to a leg fork 40, located on the corresponding leg 22. Thus, the legs 22 can fold as the base sleeve 34 slides downward. In the open or unfolded position, as shown in FIG. 2, the base sleeve 34 abuts against the wider diameter of top portion 32, and the legs 22 are held in fixed position.

It is known in the prior art to use claws to join the links. The present invention provides forks instead, which give greater strength and durability to the system, in addition to facilitating assembly, because they are in the form of molded parts to be inserted and fixed. In addition, a better finish is achieved. The forks are also used in the preferred embodiment of the '579 patent.

Each leg 22 has a suction cup 26 at its free end for adhering to the floor, thereby preventing the stool from tipping over. In the exemplary embodiment, the suction cups 26 have a patterned, textured anti-skid design in that portion placed in contact with the floor, lending still greater stability to the stool and allowing more abrupt movement without danger of overturning.

Projecting axially upward from the hub 18 is a spring hinge assembly 8. A cylindrical stub 42 is formed on the top of hub 18 and mounts into spring 46. Unlike the stub used in the stool of the '579 patent, the stub 42 has a smooth radial surface, free from helical grooves. This smooth surface facilitates assembly by requiring only insertion of the stub 42 into the spring 46 rather than a threading process. The upper end of the spring 46 is joined in similar manner to an inverted cylindrical plug 50. Restraining pins 43 prevent the spring 46 from uncoupling from stub 42 and the stub 50. The plug 50 and the stub 42 are separated so that the spring 46 may flex. This spring hinge assembly 8 allows the seat 14 and support column 12 to incline relative to the base 10.

Because the spring hinge assembly 8 permits the upper portion of the stool to tilt in any direction, provision must be made to support the stool against tilting in the backward direction which would cause the user to lose his balance. To achieve this support, a pair of stabilizing member 16 are connected to the support column 12.

The flared base 12*a* of the support column 12 is rotatably connected to plug 52. Above the flared base 12*a*, the column 12 diminishes in diameter. At the level of the support column 12 where the diameter no longer decreases, a collar 72 is fixed, having two radial collar forks 74 approximately 60 degrees apart. The support column 12 carries a flange 54 at a distance axial above the collar 74. This flange 54 serves as a bottom abutment for a column sleeve 66. The column sleeve 66 also provides a pair of slide forks 68 in alignment with the collar forks 74.

The upper ends of the stabilizing members 16 are pivotally attached to these slide forks 70. The stabilizing members comprise bar forks 76 which pivotally connect to links 78, which in turn connect to the corresponding collar forks 74. The pivot-slider linkage thus formed allows the stabilizing legs 16 to fold relative to the support column 12.

When the support column 12 is inclined in a forward direction, the lower ends of the stabilizing members 16 slide toward the base 10, permitting the user to use his legs to obtain balanced support in the tilted position. Pivoting on the links 78, the upper ends of the stabilizing members 16 urge the column sleeve 66 up the upper column portion 56. When the support column 12 is tilted a sufficient distance forward, the lower ends of the stabilizing members 16 could collide with the base legs 22.

To prevent this collision, a clamp 57 with screw 55 is mounted on the upper column portion 56. As the column sleeve 66 slides up the column portion 56, its travel is limited by the clamp 57. Correspondingly, the lower ends of the stabilizing members 16 are prevented from interacting with the base legs 22. The clamp 57 can be positioned at various heights to control the limiting of the stabilizing members 16.

When the user urges the upper portion of the stool backward, the inclination is resisted by the stabilizing members 16. The backward force tends to urge the stabilizing members 16 outward and back, but the flange 54 prevents the column sleeve 66 from traveling downward. Hence, by the linkage system, the stabilizing members 16 cease to spread out when the seat 14 is in an upright position by the user and thereby support the stool against backward inclinations.

Each stabilizing member 16 has at its lower end a rubber roller 80 giving greater mobility and preventing damage to the floor. In addition, special sectional rollers may be provided for use on carpets.

One of the major improvements made to the stool of the '579 patent by the present invention is the repositioning of the point of rotation. In the stool of the '579 patent, the seat 14 swivels with respect to the support column 12 while the support column 12 is fixed in rotation relative to the spring hinge assembly 8 and base 10. With the prior art structure, it is possible for the user to rotate the seat 14 so that the stabilizing members 16 are no longer positioned directly behind him. As a result, when the user leans the seat 14 backward, the stabilizing members 16 are not correctly positioned to offer support and the user loses his balance.

The swivel mechanism of the present invention ensures that the stabilizing members 16 rotate with any rotation of the seat 14, thereby providing maximum support against backward inclination at all times. This swivel mechanism is disposed between the bottom and middle sections 1 and 2, that is, below the interface between the stabilizing members 16 and the support column 12. In the stool of the '579 patent, the plug 50 is connected directly to the support column 12 such that the support column 12 cannot be rotated relative to the spring hinge assembly 8. In the present invention, however, the upper end of the cylindrical plug 50 provides a pivot post 48. A rotatable socket 49 is disposed around the base of the pivot post 48. The socket 49 is held in place by a keeper 51 mounted in a radial groove in the pivot post 48.

The pivot post 48 fits into a flared cylindrical chamber 47 formed in a support column 12. This flared chamber 47 mates with the pivot post 48 and provides a housing for the keeper 51. The bottom edge of the support column 12 rests on the socket 49 so that the support column 12 may rotate relative to the spring hinge assembly 8 and the base 10. In addition, the fitting of the pivot post 48 into the chamber 47 permits the bottom and middle sections 1 and 2 to be easily coupled and uncoupled.

The support column 12 of the middle section 2 extends upward past the column sleeve 66 and the clamp 57 and slidably connects with the components of the top section 3. The top section 3 of the stool comprises a seat support rod 60 which slidably mounts inside the hollow upper column portion 56 and provides an axial groove 63 in which a key 61 on the inner wall of the upper column portion 56 is disposed. This key 61 serves two functions: it serves as a guide for the seat support rod 60 and ensures that the upper column portion 56 and the seat support rod 60 do not rotate relative to each other.

The seat support rod 60 increases in diameter to form a flange collar 65. Referring to FIG. 1, height adjustment sleeves 64 can be slid on the seat support rod 60 below the collar 65, thereby raising the seat support rod 60 relative to the upper column portion 56 in order to adjust the height of the seat 14 according to the user's requirements. Above the collar 65, the seat support rod 60 increases in diameter as it increases in height, forming an inverted cone portion 58. This cone portion 58 decreases in diameter at the top, where a pin 69 protrudes. The seat 14 provides a vertical slot 62 for coupling with the pin 69, thereby preventing rotation of the seat 14 relative to the seat support rod 60.

The seat 14 of the present invention represents another significant modification of the stool of the '579 patent. Formerly, the seat has been formed in a generally rectangular shape which the user straddles between his legs. In order to rotate the prior art seat, the user must urge a side of the seat with one of his inner thighs according to the direction he wishes to rotate. In addition, the seat of the prior art stool offers no lateral support to the user. The standing load from the user's upper body is supported in the center, often causing cramping in the central muscle groups of the thighs and buttocks.

The seat of the present invention not only provides the user with greater control and ease of rotation but also distributes his body weight across a greater area than does the prior seat design. Referring to FIGS. 3 and 4, the anatomical heat has a broad base for supporting the user's entire posterior thereby minimizing the standing load supported by the legs and thus reducing fatigue and cramping. In addition, the seat provides lateral extensions **14*a* and a center extension 14*b*** forming two contoured cut-aways for placement of the upper thighs. Because the upper thighs are disposed between these extensions, the user may use both thighs to rotate the stool. This double thigh motion provides greater ease because more muscles can be used and greater control because one thigh can be used to exert rotational force while the other serves as a dampener or brake. The seat can be adapted to include a cushion, an inflatable gas bladder, or a water bladder, thus providing greater comfort to the user. Further, the seat may be designed with or without a back, according to user needs and preferences.

It should be noted that the present invention has been described in terms of a preferred embodiment thereof and that variations and modifications may be made in the light of the preceding teachings. Accordingly, these variations and modifications are to be understood as included within the scope of the present invention. Moreover, the invention should not be limited by the features described above but only by the following claims:

I claim:

1. An inclinable stool for supporting the standing weight of a user's body and permitting the user's body to take a variety of inclined positions relative an upright position, comprising:

a base having spaced floor engaging base legs;

a support column, carrying a seat assembly at its upper end;

a self-centering resilient hinge assembly extending vertically from the base, said resilient hinge assembly mounting the support column to the base and allowing the support column to rotate and tilt relative to the resilient hinge assembly and base;

a sleeve slidably mounted on the support column above the resilient hinge assembly;

a pair of spaced stabilizing members with upper ends pivotally connected to the sleeve and having floor engaging lower ends outwardly extending beyond the base legs, wherein said stabilizing members rotate with the support column;

a collar fixed on the support column between the sleeve and the resilient hinge assembly; and a shoulder on the support column defining a stop for limiting the downward sliding motion of the sleeve and thereby limiting the outward spread of the stabilizing members.

2. The inclinable stool according to claim 1 wherein the seat assembly comprises a seat axially mounted on a seat support rod, said seat support rod being slidably mounted to the support column and rotating with the support column.

3. The inclinable stool according to claim 1, wherein the support column is rotatably connected to the resilient hinge assembly by means of a swivel assembly.

4. The inclinable stool according to claim 3 wherein the swivel assembly comprises:

a pivot post extending vertically from a top plug member of the resilient hinge assembly;

a socket surrounding the base of the pivot post and rotatably disposed on the top surface of the plug member;

said pivot post being disposed in an axial chamber formed at base of the support column, said support column base forming an annular surface surrounding the axial chamber, said annular surface disposed on the top surface of the socket whereby the support member may rotate axially relative to the plug member; and a keeper means disposed around the pivot post for securing the axial position of the socket.

5. An inclinable stool according to claim 3 wherein the stool is separable into three parts, separable at the junction between the support column and the swivel assembly and at the junction between the support column and the seat assembly.

6. An inclinable stool according to claim 1, further comprising:

a clamp means secured by a screw to the support column above the slidably mounted sleeve, said clamp means restricting the axial travel of the sleeve, thereby limiting the travel of the stabilizing members toward the base.

7. An inclinable stool according to claim 1, further comprising:

suction cups at the floor engaging ends of the base legs for securely holding the stool and preventing the base from tipping.

8. An inclinable stool according to claim 7 wherein the surfaces of the suction cups which contact the floor have a patterned, textured surface for preventing skidding of said suction cups.

9. An inclinable stool according to claim 1 wherein the stabilizing members have rollers at their lower ends for greater mobility.

10. An inclinable stool according to claim 2 wherein the seat provides lateral extensions outside a user's upper thighs and an inner extension between the user's upper thighs for allowing both upper thighs to be used for seat rotation.

11. An inclinable stool according to claim 1 wherein the seat support rod provides an axial flange for limiting the insertion of the seat support rod into the support column and wherein height adjustment sleeves can be mounted onto the seat support rod between the flange and the upper surface of the support column, thereby raising the height of the seat according to a user's requirements.

12. An inclinable seat according to claim 1 wherein the base legs are connected to molded forks fixed to the base hub; and wherein the stabilizing members comprise molded forks fixed thereto for pivotally connecting to elongated links pivotally connected to molded forks fixed to the collar; and wherein the slidably mounted sleeve comprises molded forks for pivotally connecting to the upper ends of the stabilizing members.

13. The inclinable stool according to claim 12 further comprising:

a base sleeve slidably mounted on the base hub and comprising molded forks fixed thereto, pivotally connecting to elongated links whose opposite ends are pivotally connected to molded forks fixed to the base legs; and wherein the upper ends of the base legs are pivotally connected to the molded forks of the base hub, whereby the base legs are downwardly foldable relative to the base hub.

14. An inclinable stool according to claim 1 wherein the resilient hinge assembly comprises:

a coil spring mounted around a smooth stub formed on the top surface of the base hub and extending vertically to mount at its opposite end around the plug member, said smooth stub and plug member being axially separated to allow flexing of the coil spring.

* * * * *.